US007285081B1

(12) United States Patent
Napoleon

(10) Patent No.: US 7,285,081 B1
(45) Date of Patent: Oct. 23, 2007

(54) RANGE-O-MATIC XERCISER

(76) Inventor: Joseph Napoleon, 1530 W 145th St. #108, Gardena, CA (US) 90247

( * ) Notice: Subject to any disclaimer, the term of this patent is extended or adjusted under 35 U.S.C. 154(b) by 425 days.

(21) Appl. No.: 10/893,028

(22) Filed: Jul. 15, 2004

Related U.S. Application Data

(60) Provisional application No. 60/487,810, filed on Jul. 17, 2003.

(51) Int. Cl.
*A63B 23/14* (2006.01)

(52) U.S. Cl. ..... 482/904; 482/44

(58) Field of Classification Search ..... 482/140, 482/121–130, 44–50, 904; 280/304.1, 304.3
See application file for complete search history.

(56) References Cited

U.S. PATENT DOCUMENTS

| | | | | |
|---|---|---|---|---|
| 5,522,783 | A | 6/1996 | Gordon | |
| 5,697,628 | A * | 12/1997 | Spear | 280/304.1 |
| 5,913,749 | A | 6/1999 | Harmon | |
| 6,142,914 | A | 11/2000 | Crawford et al. | |
| 6,655,708 | B2 * | 12/2003 | Handago | 280/304.3 |
| 2003/0125171 | A1 * | 7/2003 | He | 482/126 |

* cited by examiner

*Primary Examiner*—Fenn C. Mathew

(57) ABSTRACT

An exercise apparatus for use, especially by those suffering from joint deterioration due to arthritis or other joint-related disease, the handicapped or individuals with limited or no range of motion. The apparatus is used primarily to stimulate upper body movement and to exercise and tone arm, chest, hand, and other muscles that are frequently not used enough when a person has to remain in a sitting position for long periods of time in a wheelchair or regular chair. The apparatus weights very little and is used primarily for "resistance exercises."

2 Claims, 3 Drawing Sheets

RANGE-O-MATIC XERCISER

I. CROSS-REFERENCE TO RELATED APPLICATIONS

This application claims the benefit of U.S. Provisional Application No. 60/478,810, filed Jul. 17, 2003.

II. BACKGROUND OF THE INVENTION

The present invention concerns that of a new and improved exercise apparatus for use, especially by those suffering from joint deterioration due to arthritis or other joint-related disease, the handicapped or individuals with limited or no range of motion.

III. DESCRIPTION OF THE PRIOR ART

U.S. Pat. No. 6,142,914, issued to Crawford et al., discloses an exercising attachment for a wheelchair.

U.S. Pat. No. 5,913,749, issued to Harmon, discloses an adaptable range-of-motion exercise apparatus.

U.S. Pat. No. 5,522,783, issued to Gordon, discloses an isotonic-isometric device for exercise and physical therapy.

IV. SUMMARY OF THE INVENTION

The present invention concerns that of a new and improved exercise apparatus for use, especially by those suffering from joint deterioration due to arthritis or other joint-related disease, the handicapped or individuals with limited or no range of motion. The apparatus is used primarily to stimulate upper body movement, increase range of motion or if used in the early stages, can prevent the loss of range of motion, and to tone and strengthen arms, shoulders, hands, fingers and chests.

Arthritis sufferers often get caught in a downward spiral when it comes to pain and exercise. Painful joints reduces the desire to move which ultimately results in muscle loss frozen joints causing even more discomfort and pain. The exercise apparatus weighs very little and is used primarily for resistance and strengthening exercises.

There has thus been outlined, rather broadly, the more important features of an exercise apparatus that the detailed description thereof that follows may be better understood and in order that the present contribution to the art may be better appreciated. There are, of course, additional features of the exercise apparatus that will be described hereinafter and which will form the subject matter of the claims appended hereto.

In this respect, before explaining at least one embodiment of the exercise apparatus in detail, it is to be understood that the exercise apparatus is not limited in its application to the details of construction and to the arrangements of the components set forth in the following description or illustrated in the drawings. The exercise apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present exercise apparatus. It is important, therefore, that the claims be regarded as including such equivalent constructions insofar as they do not depart from the spirit and scope of the present invention.

It is therefore an object of the present invention to provide an exercise apparatus which can be carried with you anywhere allowing you to exercise while traveling, on your lunch break, and not confining you to a large machine in designated area.

It is another object of the present invention to provide an exercise apparatus which has all of the advantages of the prior art and none of the disadvantages.

It is another object of the present invention to provide an exercise apparatus which may be easily and efficiently manufactured and marketed.

It is another object of the present invention to provide an exercise apparatus which is of durable and reliable construction.

It is yet another object of the present invention to provide an exercise apparatus which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
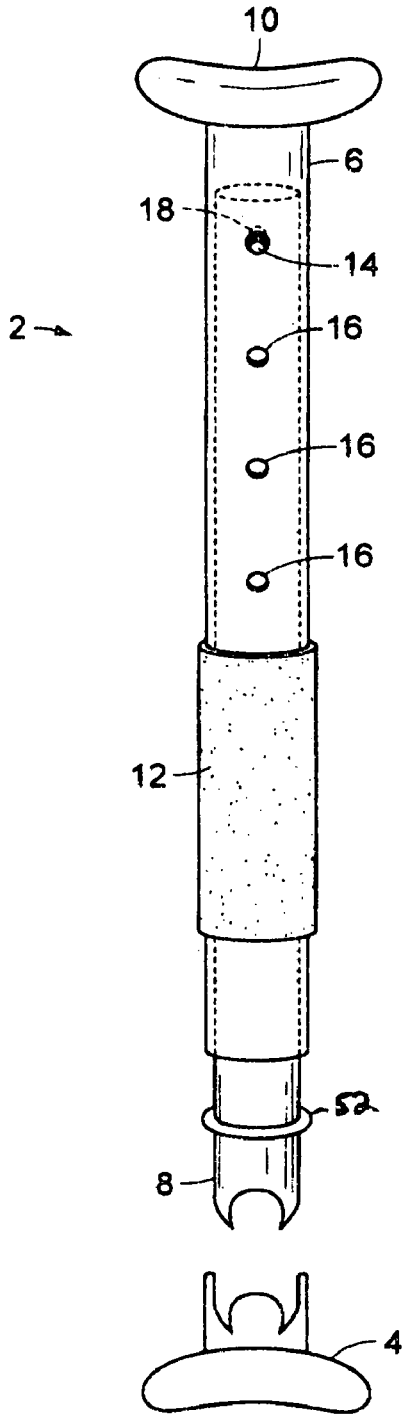
FIG. 1 shows a perspective view of the apparatus as it is being connected to the bottom hand rest.
Figure 2:
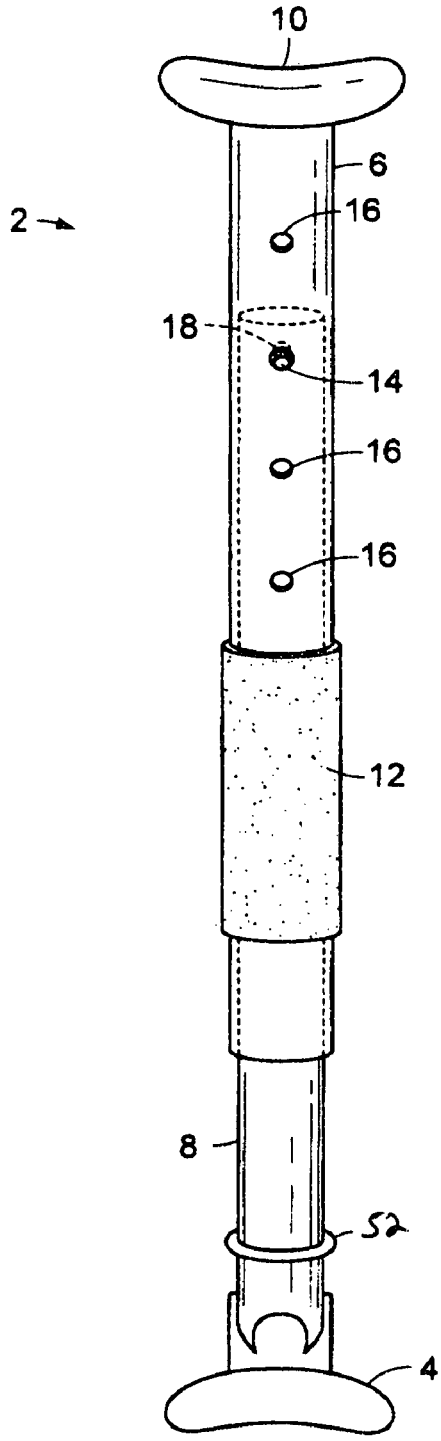
FIG. 2 shows a perspective view of the apparatus after it has been connected to the bottom hand rest.

FIG. 1 shows a perspective view of the apparatus 2 as it is being connected to the bottom hand rest 4, while FIG. 2 shows a perspective view of the apparatus 2 after it has been connected to the bottom hand rest 4.

Apparatus 2 is an exercise mechanism which would be used by individuals to improve muscle strength and tone in primarily the upper part of their body. The target market of the apparatus 2 is people who are either in wheelchairs or people who are handicapped and must remain in a sitting position most of the time. People such as this frequently do not get exercise, and over time, their muscle mass and overall muscle tone begin to deteriorate. It is believed that this helps contribute to aging. By using the apparatus 2 properly, however, a user can help to maintain muscle mass and tone in their upper body.

Apparatus 2 comprises an upper tube 6 and a lower tube 8. Upper tube 6 and lower tube 8 each have two ends, a top end and a bottom end. The top end of upper tube 6 has an incorporated cushion hand rest 10 which can serve either as a squeeze pad or merely as an item of apparatus 2 on which pressure can be applied.

Upper tube 6 has a foam grip 12 attached to it near the bottom end of upper tube 6, with foam grip 12 being about three to four inches in length. Foam grip 12 is long enough to allow a user to grasp the foam grip 12 and squeeze it with their entire hand.

The bottom end of upper tube 6 is open, and upper tube 6 is hollow. The top end of lower tube 8 is insertable into the bottom end of upper tube 6. The upper half of lower tube 8 has a spring-loaded extension button 14 that always pushes upward, but can be pushed slightly in from its outermost position. This extension button 14 can be used in conduction with a plurality of holes 16 that are located on the upper tube 6 to lock the lower tube 8 at a certain position in relation to the upper tube 6.

The plurality of holes 16 are lined up in a row on the upper tube 6 in between the top end of upper tube 6 and the location of foam grip 12. The holes 16 are spaced apart at equal lengths and a user can removably lock in the lower tube 8 in relation to the upper tube 6 by allowing the button 14 to pop out a particular hole 16. If a user wants the apparatus 2 to be longer or shorter, the user merely needs to push in button 14 until a user can slide around lower tube 8 within upper tube 6, and then choose another hole in which to allow button 14 to once again be pushed out. Button 14 has an incorporated spring 18 located within lower tube 8 to provide a constant outward force.

The bottom end of lower tube 8 has a rubber stopper 52 which ensures that the entire length of lower tube 8 is not accidentally inserted into the upper tube 6. If this occurred, it might be difficult to retrieve the lower tube 8 out of the upper tube 6.

As seen in FIG. 1, the bottom end of lower tube 8 is configured as a wheelchair connector. However, bottom hand rest 4 can also be attached to the bottom end of lower tube 8 when it is not actually attached to a wheelchair. By attaching bottom hand rest 4 to apparatus 2, a user can then use apparatus 2 as a free-standing device not attached to anything else.

Figure 3:
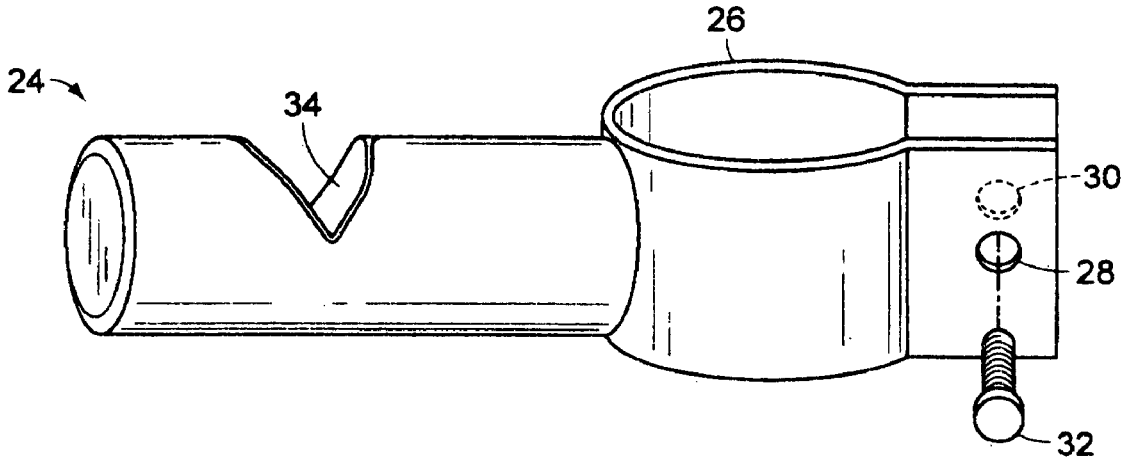
FIG. 3 shows a front perspective view of the wheelchair adapter used with the present invention.

FIG. 3 shows a front perspective view of the wheelchair adapter 24 used with the present invention. Adapter 24 has two ends, a first end and a second end, with the first end of adapter 24 having a clamp 26 and a pair of holes 28 and 30. A user would attach clamp 26 to a metal pole on a wheelchair and would then insert a screw 32 through holes 28 and 30 and tighten the screw 32 in order to secure the clamp 26 to a vertical pole 36 on the wheelchair 38.

The second end of adapter 24 has rubber stopper 34, which allows for insertion of the bottom end of lower tube 8 of apparatus 2. Rubber stopper 52 on the bottom end of lower tube 8 allows for limited insertion of apparatus 2 into adapter 24, while ensuring that it is not inserted too far.

Figure 4:
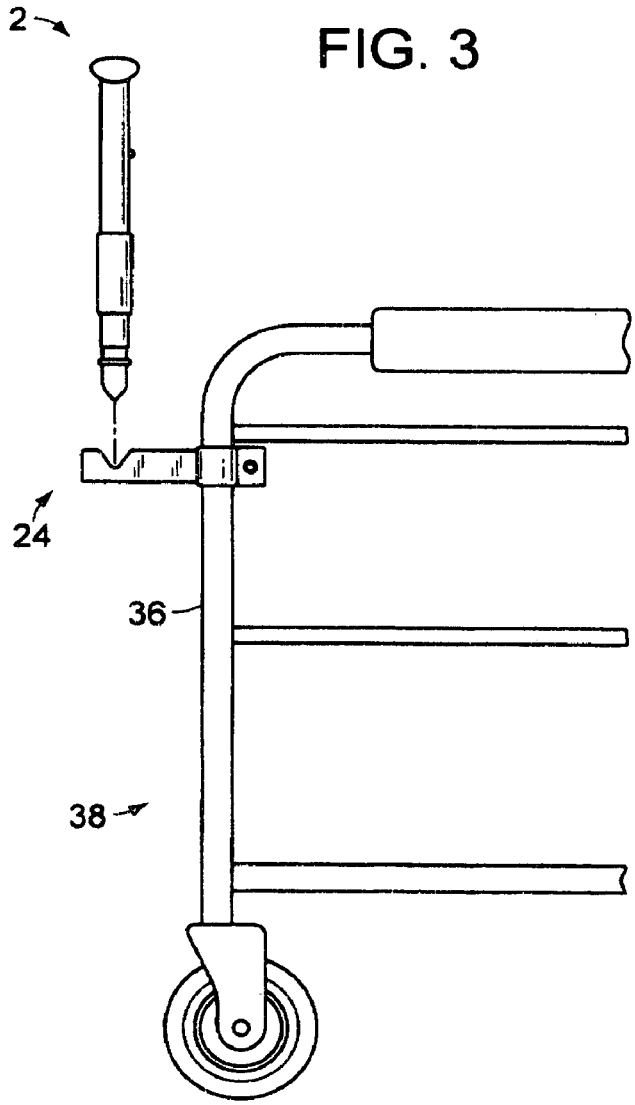
FIG. 4 shows a side view of the wheelchair adapter used with the present invention as they would appear attached to the side of a wheelchair.

FIG. 4 shows a side view of the wheelchair adapter 24 used with the apparatus 2 as it would appear attached to a vertical pole 36 of a wheelchair 38.

Figure 5:
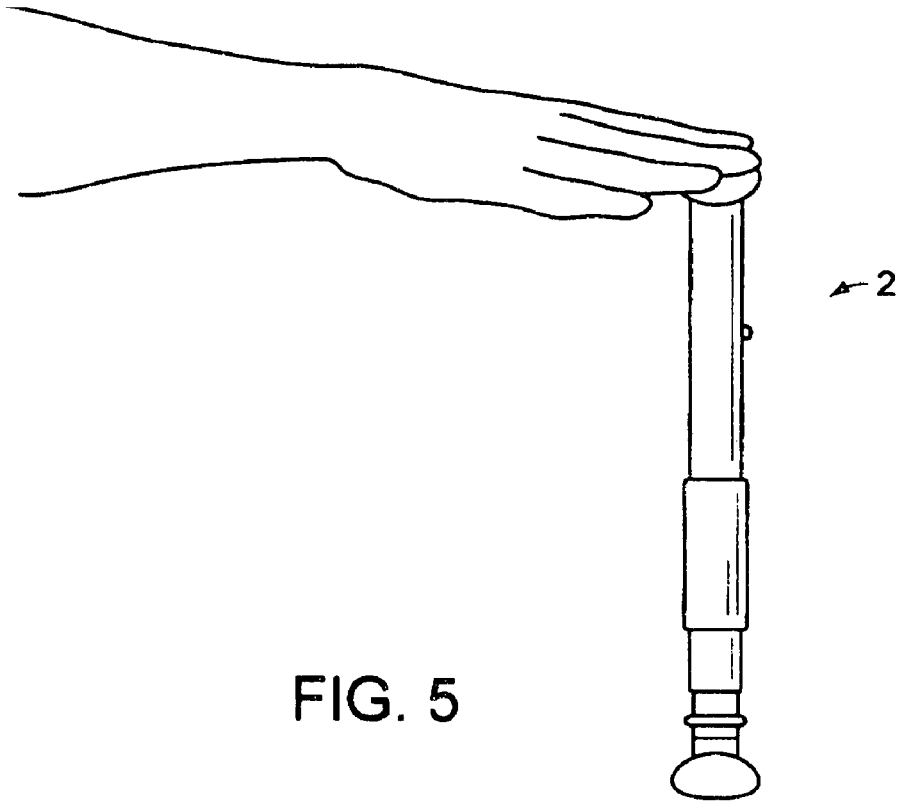
FIGS. 5 and 6 are pictorial representations of just two of the exercises the present invention can be used to improve muscle strength, tone, and overall conditioning.
Figure 6:
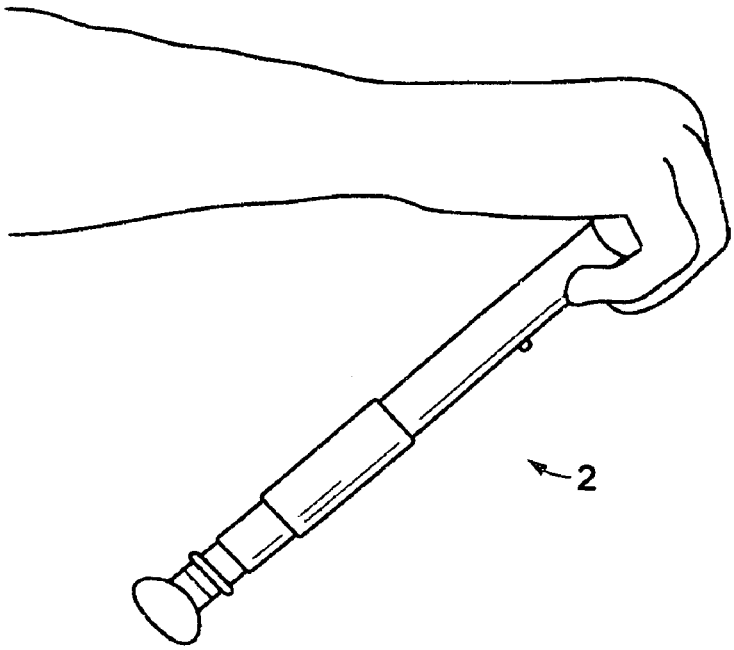

FIGS. 5 and 6 are pictorial representations of just two of the exercises the apparatus 2 can be used to improve muscle strength, tone, and overall conditioning. The following exercises, listed below, are simply instructions for just a few of the exercises the apparatus 2 can be used to help an individual exercise.

Abduction and Adduction:

1. Holding the apparatus 2 upright, rotate arm completely out to side and back across chest (repeat).
2. With arm completely extended out to side (hold), rotate neck from side to side, then around and round (repeat). Place arm completely extended out to side (hold), raised and lower shoulder only, then roll shoulder in a circular motion (repeat).
3. Slide shoulder forward and backward (repeat).

Elbow Bends and Extensions:

1. Holding the apparatus 2 upright, extend arm completely forward. Rotate from side to side (repeat).
2. Extending arm completely forward, rotate backward, bending elbow each repetition.
3. Roll arm in a circular motion, always bending the elbow.

Finger and Wrist Stretch:

1. With hand on hand rest 10 of apparatus 2, flex wrist by pressing down and releasing (repeat).
2. Place ball of fingertips on hand rest 10, press down, hold, stretch, and release (repeat).
3. Place hand squeeze between index and middle finger, squeeze and hold for five (5) seconds, then release. Alternate fingers (middle finger and ring finger, etc.).

Hand Squeeze:

1. Hold hand squeeze in palm of hand, squeeze and hold five (5) seconds and release (repeat).

Arm Stretch/Slide:

1. Attach bottom hand rest to arm connector. Holding hand rests in each hand directly in front of the individual, chest high, squeeze and hold five (5) seconds, release (repeat).
2. Holding hand rest in each hand, chest high, holding left arm still, pushing completely out with right arm (repeated and reverse pushing arm).
3. Hand rest in each hand, holding in front of you in lap, keeping elbows straight, raise up as far as you can. (The goal is to raise it over and behind your head).
4. Holding apparatus 2 in the same manner as number #3, rotate arm from lap to chest in a circular motion, bending the elbows. Reverse circular motion and repeat.
5. Hold the same, with elbows straight, rotate clockwise and counter-clockwise and repeat.
6. Holding the same, extend arms out, chest high, push out and pull in and repeat.

What I claim as my invention is:

1. An apparatus for exercising upper body muscles, the apparatus comprising:

an upper tube having a top end and a bottom end, the upper tube being hollow, a lower tube having a top end and a bottom end, the upper tube being hollow, a first hand rest attached to the top end of the upper tube, a foam grip attached to the upper tube, means for attaching the apparatus to a wheelchair, wherein the wheelchair includes at least one vertical pole, and means for adjustably attaching the bottom end of the upper tube to the top end of the lower tube, wherein the means for adjustably attaching the bottom end of the upper tube to the top end of the lower tube further comprises:

a spring-loaded extension button located on the lower tube, a plurality of evenly spaced apart holes located on the upper tube, the plurality of holes located in a linear row between the top end of the upper tube and the foam grip, a spring integrally attached to the extension button to provide outward pressure, wherein the top end of the lower tube is insertable into the bottom end of the upper tube, wherein an individual may slide the lower tube around in the upper tube until the extension button extends outward through on of the holes of the plurality of holes, wherein the means for attaching the apparatus to a wheelchair further comprises:

a wheelchair adapter having two ends, a first end and a second end, a clamp attached to the first end of the wheelchair adapter, a rubber stopper located near the second end of the wheelchair adapter, attachment means for attaching the clamp to a vertical pole on the wheelchair, wherein the bottom end of the lower tube is insertable into the rubber stopper.

2. An apparatus for exercising upper body muscles according to claim 1 wherein the apparatus further comprises a second hand rest, the second hand rest attached to the bottom end of the lower tube.

* * * * *